US005988069A

United States Patent [19]

Bailey

[11] Patent Number: 5,988,069

[45] **Date of Patent: *Nov. 23, 1999**

[54] ELECTRIC INITIATOR HAVING A SEALING MATERIAL FORMING A CERAMIC TO METAL SEAL

[75] Inventor: Todd Raymond Bailey, Higley, Ariz.

[73] Assignee: Universal Propulsion Company, Inc., Phoenix, Ark.

[ * ] Notice: This patent issued on a continued prosecution application filed under 37 CFR 1.53(d), and is subject to the twenty year patent term provisions of 35 U.S.C. 154(a)(2).

[21] Appl. No.: 08/747,349

[22] Filed: Nov. 12, 1996

[51] Int. Cl.[6] ..... F42C 19/098; F42C 19/12

[52] U.S. Cl. ..... 102/202.9; 102/202.5; 102/202.14

[58] Field of Search ..... 102/202.14, 202.9, 102/202.7, 202.8, 202.2, 202.1, 202.5; 280/737, 741

[56] References Cited

U.S. PATENT DOCUMENTS

| | | | |
|---|---|---|---|
| 2,872,870 | 2/1959 | Gey . | |
| 3,101,669 | 8/1963 | Gatley et al. . | |
| 3,134,329 | 5/1964 | Zeman . | |
| 3,175,492 | 3/1965 | Reyne et al. . | |
| 3,971,320 | 7/1976 | Lee . | |
| 4,103,619 | 8/1978 | Fletcher et al. . | |
| 4,110,813 | 8/1978 | Hoheisel et al. . | |
| 4,249,673 | 2/1981 | Katoh et al. . | |
| 4,261,263 | 4/1981 | Coultas et al. . | |
| 4,267,567 | 5/1981 | Nygaard et al. . | |
| 4,271,453 | 6/1981 | Yajima et al. . | |
| 4,378,738 | 4/1983 | Proctor et al. . | |
| 4,422,381 | 12/1983 | Barrett . | |
| 4,592,280 | 6/1986 | Shores . | |
| 4,616,565 | 10/1986 | Reinovsky . | |
| 4,690,063 | 9/1987 | Granier et al. . | |
| 4,959,011 | 9/1990 | Nilsson . | |
| 5,054,395 | 10/1991 | Vetter et al. . | |
| 5,056,815 | 10/1991 | Geisreiter | 280/736 |
| 5,099,762 | 3/1992 | Drapala | 102/202.1 |
| 5,131,679 | 7/1992 | Novak et al. . | |
| 5,140,906 | 8/1992 | Little, II . | |
| 5,142,982 | 9/1992 | Diepold et al. | 102/202.5 |
| 5,153,368 | 10/1992 | Fogle, Jr. . | |
| 5,178,547 | 1/1993 | Bonas et al. . | |
| 5,253,584 | 10/1993 | Allford . | |
| 5,387,009 | 2/1995 | Lauritzen et al. . | |
| 5,403,036 | 4/1995 | Zakula et al. | 280/741 |
| 5,404,263 | 4/1995 | Graves et al. | 361/247 |
| 5,423,261 | 6/1995 | Bernardy et al. | 102/202.14 |
| 5,433,147 | 7/1995 | Brede et al. | 102/202.2 |
| 5,433,476 | 7/1995 | Materna et al. . | |
| 5,454,320 | 10/1995 | Hilden et al. . | |
| 5,483,896 | 1/1996 | Hock et al. . | |
| 5,487,559 | 1/1996 | Headley | 280/735 |
| 5,496,062 | 3/1996 | Rink et al. | 280/737 |
| 5,556,132 | 9/1996 | Sampson | 280/741 |
| 5,558,366 | 9/1996 | Fogle, Jr. et al. | 280/736 |

(List continued on next page.)

OTHER PUBLICATIONS

Webster's II New Riverside University Dictionary, "recess", p. 982, 1994.

*Primary Examiner*—Charles T. Jordan
*Assistant Examiner*—Christopher K. Montgomery
*Attorney, Agent, or Firm*—Pennie & Edmonds LLP

[57] ABSTRACT

An airbag initiator having an ignition charge and a low temperature ignition charge in an inner case and a metal header closing the inner case, a glass seal providing feed through of one or more electrical connections to the ignition charge through the header. The seal is preferably formed using glass material. A ceramic base supports the header and their spaced relationship maintained by a single continuous glass seal. The ceramic base and glass seal electrically isolates the header and ignition charge against accidental ignition. The ceramic to glass to metal seal provides protection against leakage of unfiltered gas from the inflator system. A ferromagnetic pressed material is assembled into the ceramic base and it's spaced relationship to the ceramic body and the electrical connections are maintained by a single continuous glass seal.

43 Claims, 9 Drawing Sheets

U.S. PATENT DOCUMENTS 5,576,509 11/1996 Refouvelet et al. ..... 102/202.7
5,596,163 1/1997 Caflisch et al. ..... 102/202.2
5,602,359 2/1997 Hambro et al. ..... 102/202.5
5,613,706 3/1997 Parker et al. ..... 280/741
5,621,183 4/1997 Bailey ..... 102/202.7
5,639,986 6/1997 Evans ..... 102/531
5,678,163 10/1997 Rice ..... 419/2

ELECTRIC INITIATOR HAVING A SEALING MATERIAL FORMING A CERAMIC TO METAL SEAL

BACKGROUND OF THE INVENTION

This invention relates to pyrotechnic devices, and more particularly to improvements in initiators for use in automotive air bag systems.

A typical air bag initiator is an electroexplosive device used to initiate a sodium azide-based propellant charge for inflation of the air bag. However, the technology of the air bag inflation system is changing and new types of inflator technology such as solid organic propellants, stored gas hybrid, liquid propellant and hydrogen oxygen flammable gas systems are being developed. As a result the requirements on the initiator system are changing to require more structural integrity of the initiator body as well as new technology which allows the initiator to be hermetically sealed into the inflator cavity under high pressure for the life of the unit. The initiator generally comprises an ignition charge which is in direct contact with a bridgewire. The bridgewire is connected between two contacts which are connectable to a firing circuit. When the bridgewire is electrically heated, it ignites the ignition charge. An output charge or "booster" charge, ignitable by the ignition charge, may be used to effect quick ignition of the sodium azide-based propellant without damaging the propellant grains.

Electrical connections are typically made to the firing circuit respectively from the initiator case and from a central conductor which is in coaxial relationship with the case and extends into the case through an insulator. Devices using this form of electrical connection are known as "coaxial" devices. Alternatively, electrical connections can be made through a pair of parallel, spaced conductors both of which extend into the interior of the initiator case through an insulator. Devices having this form of electrical connection are known as "twinaxial" devices.

One of the problems encountered in the manufacture, installation and use of airbag initiators is the problem of protection against accidental ignition resulting from static electricity. A substantial static charge can accumulate on a worker's body, for example by the rubbing of leather soles of the worker's shoes on a nylon carpet. This accumulated static charge can be discharged as a spark through the ignition material in an initiator, from the case to the firing circuit, when the initiator is touched, or when an ungrounded conductor in contact with the initiator is touched.

To prevent unintended ignition from occurring as a result of static discharge through the pyrotechnic material in the initiator, the case of the initiator may be connected electrically to the firing circuit. This allows the energy of the static charge to be dissipated in a low resistance connection, through the firing circuit, from the initiator case to the automobile body. In a coaxial device, the initiator case is normally connected to the firing circuit. In one form of twinaxial device, one of the two parallel conductors is connected electrically to the initiator case in order to provide a path for dissipation of static energy through the firing circuit. Alternatively, a spark gap may be provided between the case and one of the conductors to allow discharge of static electricity through the spark gap rather than through the pyrotechnic charge.

Preferably, in a device in which the initiator case is electrically connected to the wiring circuit, the initiator case is designed so that it does not directly contact the automobile body. For example, the case may be provided with a non-conductive cover made of plastics material. In the case of a single pole-switched firing circuit, this construction eliminates the possibility of a short circuit if the polarity of the D.C. supply to the firing circuit is accidentally reversed. It also eliminates the possibility of accidental firing, which could occur if the firing circuit supply polarity is reversed, the output leads of the firing circuit are also accidentally interchanged, and the case of the initiator touches the automobile body. Isolation of the case from the automobile body also makes it possible to use a two pole-switched firing circuit.

Constructing the device in such a way as to isolate the initiator case from the automobile body introduces the possibility of leak paths for high pressure gas generated by the propellant. Production of the plastic-covered case also requires an expensive insert molding operation.

SUMMARY OF THE INVENTION

Among the objects of this invention are the provision of a simple and easily manufactured form of initiator; inherent protection against accidental firing as a result of static discharge, prevention of unintended firing due to wiring errors; easy mounting; high structural strength; prevention of gas leakage through the initiator; and applicability both to coaxial and twinaxial initiators.

The initiator in accordance with the invention, comprises the inner case containing an ignition charge and an autoignition charge and being closed by a metal header having a through passage for one or more electrical conductors and a glass seal. The autoignition charge is designed to function the initiator system prior to a loss of structural integrity in the inflator system. The header is supported by a ceramic base, and the ceramic base and the header are held together by a single glass seal. This allows the header to be electrically isolated from the system. The ceramic base provides a mounting flange for the initiator.

The preferred form of the initiator comprises an ignition charge, an autoignition charge; a charge holder welded to the header to retain the ignition charge and the autoignition charge; an output charge; a metal cup filled with an output charge and enclosing the ignition charge; a bridgewire in contact with the ignition charge; a header fitting the opening of the metal cup, and having a through passage; and means providing a single or pair of conductors for connecting the bridgewire to a firing circuit. At least one of these conductors extends through the passage of the header and outward beyond the header. The initiator further comprises glass sealing means in the header passage for maintaining the conductors in spaced relationship to each other, and for maintaining at least one of the conductors in spaced relationship to the header. The seal also provides the attachment of the header to the ceramic base and maintaining the conductors in spaced relationship to each other and spaced relationship to the ceramic base. An electrical connection is provided between the header and the other one of the conductors. An electrically non-conductive cup is provided over the metal cup to electrically isolate the metal cup from the inflator system. The ceramic base includes a mounting flange.

The use of ceramic to glass to metal seal in the base isolates the header electrically from the inflator system and from the firing circuit, and, at the same time, eliminates possible leak paths for the high pressure gas generated by combustion of the propellant composition.

A modified version of the invention contains a second glass seal for maintaining the ceramic body in a spaced relationship to an outer metal shell. In this application the metal shell is used as a weld point to weld the initiator into a pressurized gas bottle. The initiator design is capable of maintaining a constant static back pressure of 5000 psi for the life of the initiator. In addition the initiator is capable of withstanding a onetime pressure impulse of 75,000 psi.

Further objects, advantages and details of the invention will be apparent from the following detailed description, when read in conjunction with the drawings.

DETAILED DESCRIPTION OF THE PREFERRED EMBODIMENTS

Figure 1:
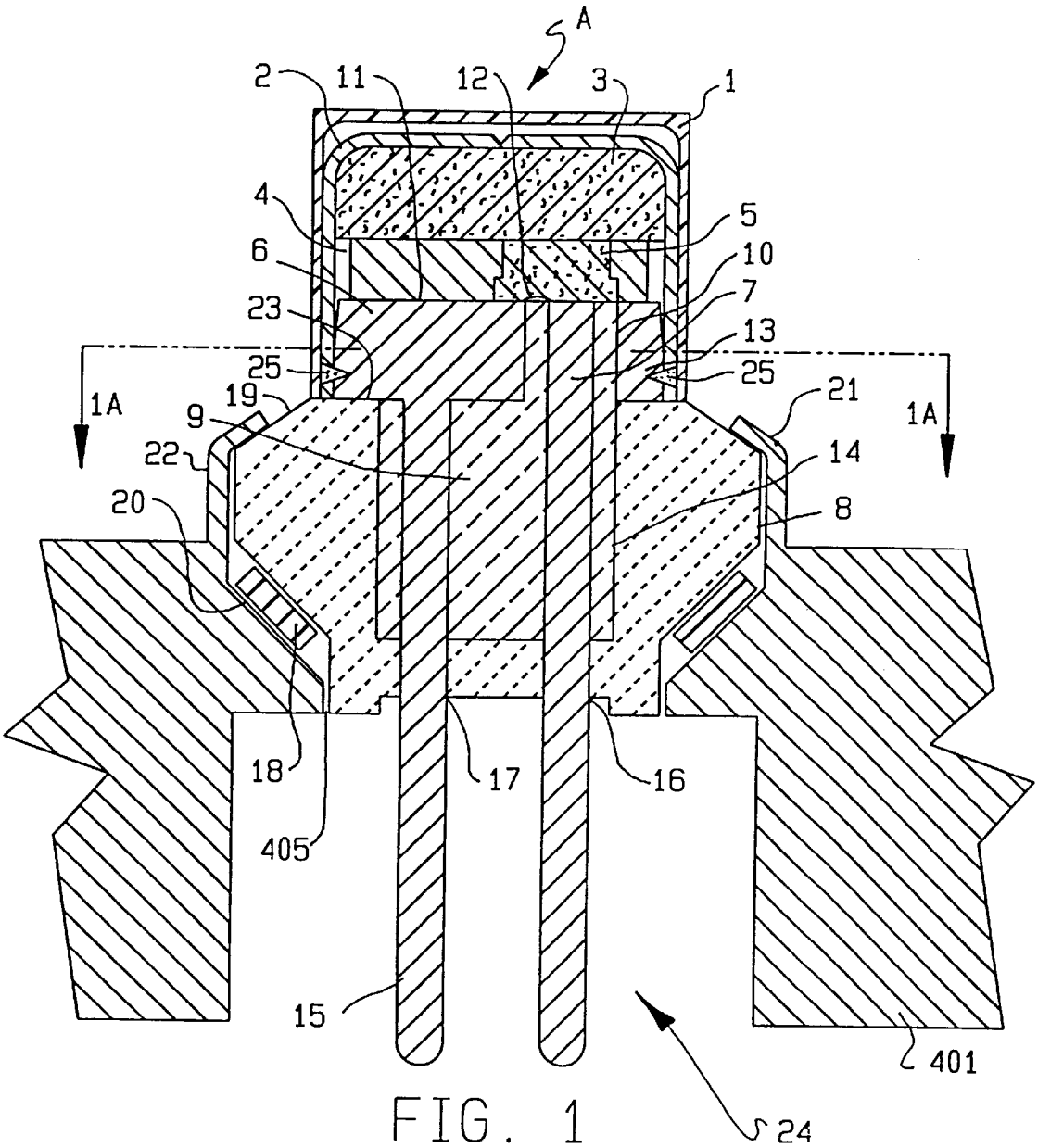
FIG. 1 is an axial section of an initiator of the coaxial type, constructed in accordance with the invention and crimped to an inflator.
Figure 1A:
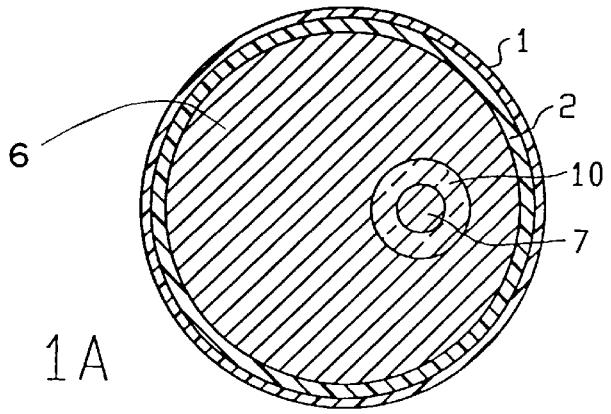
FIG. 1A is a sectional view through line 1A—1A of FIG. 1.
Figure 8:
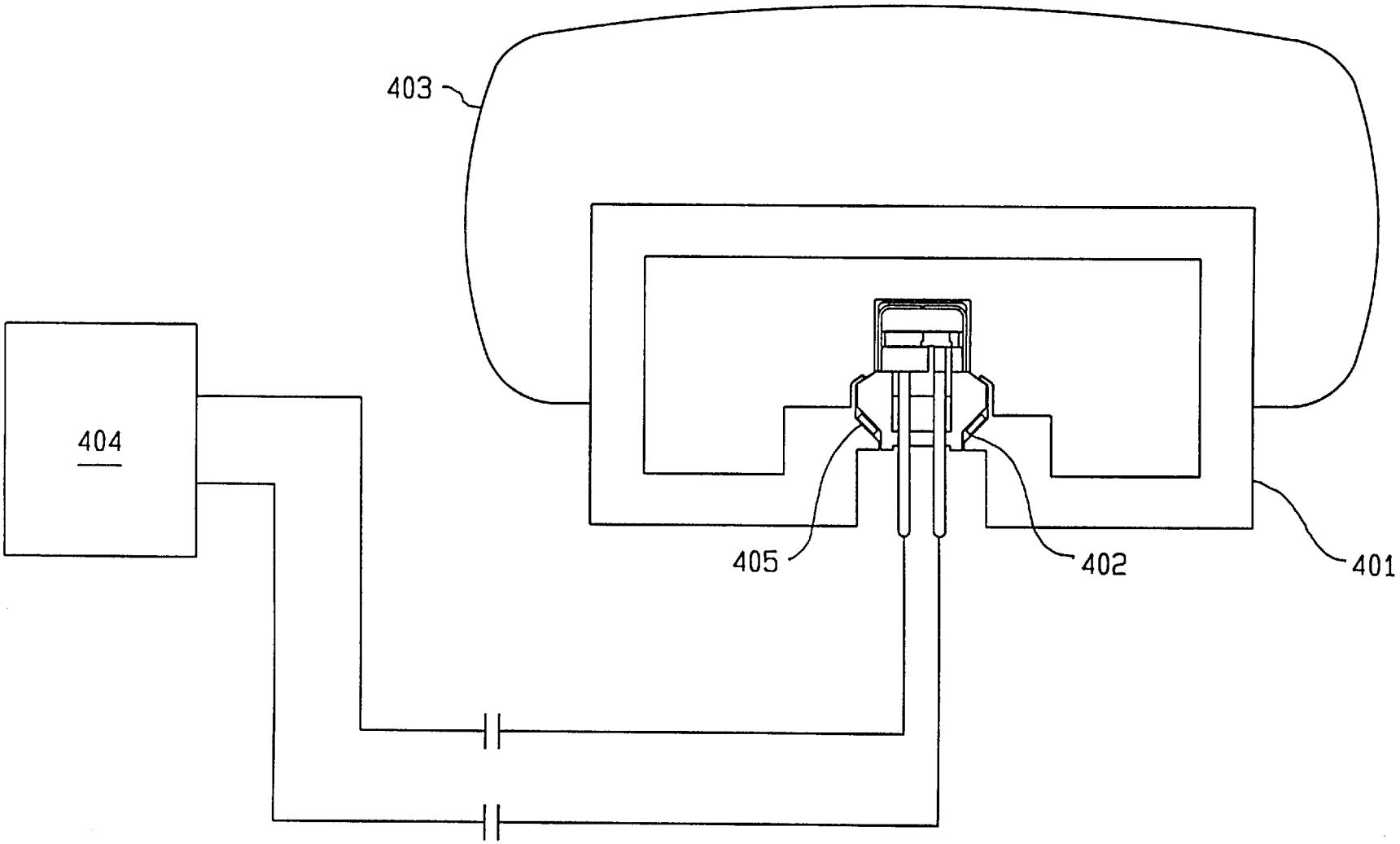
FIG. 8 is a schematic view of a vehicle occupant protection apparatus including the initiator of the present invention.

Referring first to FIGS. 1, 1A and 8, a coaxial initiator A is positioned in a cavity 405 of inflator 401. Initiator A comprises a metal cup 2 welded at the base of metal header 6. An ignition charge 5, typically a mixture of zirconium powder and potassium perchlorate is contained within metallic charge holder 4. The output charge 3, typically a mixture of titanium hydride powder and potassium perchlorate is contained within cup 2. Other suitable charge materials may be used.

Header 6 has a cylindrical header through passage 10 in which one electrode conductor 7 extends terminating at the upper surface 11 of the header. Conductor 7 is connected to header 6 by a bridgewire 12 which is in contact with the ignition charge 5. The bridgewire 12 is heated by current from the firing circuit to ignite the ignition charge 5. Conductor 7 is maintained in spaced relationship with the header through passage 10 by glass material 9 which forms a seal between base 8 and conductors 7 and 15.

Base portion 13 of the header 6 creates an interference fit with the metal cup 2 and header 6. Metal cup 2 is attached at base portion 13 of header 6 using a 360° penetration through laser weld 25. This weld joint acts to physically seal the enclosure and structurally retains the metal cup 2 onto the header 6 during functioning of the initiator.

The ceramic base 8 of initiator A has a cylindrical central ceramic body passage 14, in which two electrode conductors 7 and 15 extend, the second conductor 15 being an integral part of the header 6. Passages 10 and 14 are aligned. The conductors 7 and 15 are maintained in spaced relationship with each other by glass seal material 9 and through holes 16 and 17 in ceramic base 8. The glass seal material 9 provides electrical isolation between the conductors 7 and 15, and at the same time provides a secure physical connection of header 6 and ceramic base 8. The following process steps may be followed to position the glass material during manufacture:

1) the ceramic base 8, header 6 and conductors 7 and 15 are fixtured spaced-apart as an assembly;
2) glass beads are placed in the space between the ceramic base 8, header 6 and electrodes 7 and 15;
3) the assembly is placed in a protective atmosphere and heated to 800–1200° C. for ¼ to 1 hour to melt the glass beads which molten glass adhere to the parts; and
4) the assembly is then slowly cooled to room temperature.

Other suitable techniques for providing a glass material seal between base 8, header 6 and conductors 7 and 15 and other initiator parts may be employed. Materials other than glass or glass materials maybe used to provide the connections and the sealing required.

Glass seal material 9 further provides a hermetic seal between the two conductors 7 and 15, and the ceramic base 8, and a hermetic seal between the header 6 and the conductor 7. The glass seal between the two conductors 7 and 15, and the ceramic base 8, and the header 6 and the conductor 7, also provide a gas tight high pressure seal to the airbag inflation system which functions to eliminate any leakage of gas from the inflator 401 through the inflator cavity 405 and the initiator A (see also FIG. 8).

The ceramic base 8 is the strength carrying member of initiator A with the load on initiator A being transferred from the header 6 to the ceramic base 8 at the interface 23, then through the ceramic base 8 to the support ledge 20.

Plastic cup 1 fits over the metal cup 2 and electrically isolates loaded initiator A from the rest of the automobile's electrical systems, thereby avoiding accidental ignition of the initiator. Static protection is afforded by the electrical connections between the metal cup 2, metal header 6 and conductor 15 which is part of header 6.

Initiator A is intended to be crimped onto inflator 401 of the airbag inflator system with installation of the initiator device being achieved when the ceramic base 8 is fitted into a cylindrical space defined by a thin upstanding annular inflator sleeve 22 which is a part of inflator 401. As shown in FIG. 1, initiator A has not yet been fully crimped leaving spaces between initiator A and inflator 401. The upper edge 21 of the annular sleeve 22 is crimped over tapered base wall 19 trapping the ceramic base 8 and the gasket 18 thereby holding the initiator firmly in place. The two conductors 7 and 15 extend through opening 24 in the airbag inflator system base.

Figure 2:
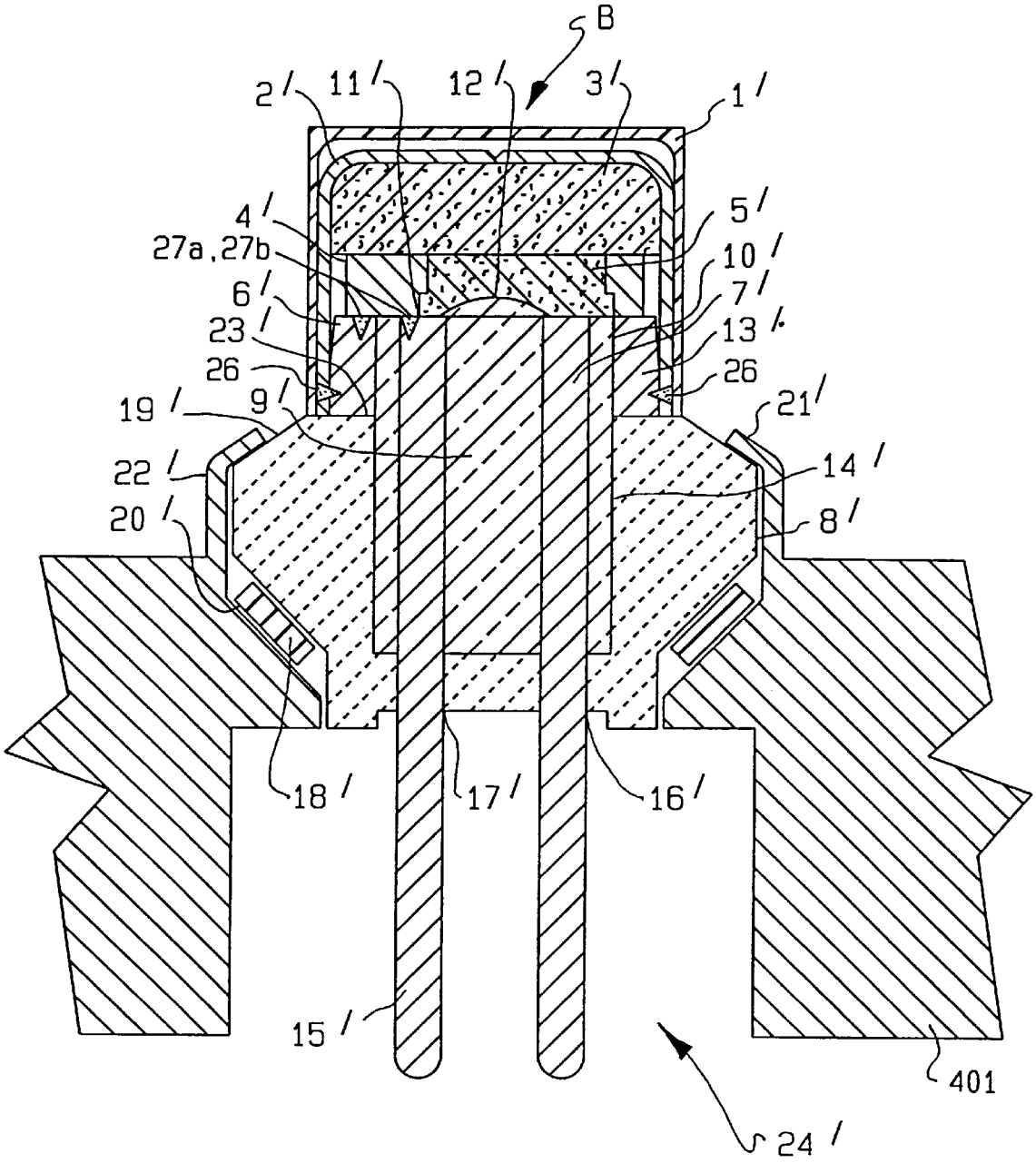
FIG. 2 is a second embodiment of the invention having variations in the conductors, charge holder and header constructed in accordance with the invention.

An alternative version of the initiator A is shown in FIG. 2, in which coaxial initiator B comprises a metal cup 2', welded at the base of the header 6'. An ignition charge 5', typically a mixture of zirconium powder and potassium perchlorate is contained within the charge holder 4'. The output charge 3, typically a mixture of titanium hydride powder and potassium perchlorate is contained within the metal cup 2. Other suitable charge materials may be used.

Header 6' has a cylindrical central through passage 10', in which both conductor 7' and 15' extend, terminating at the upper surface 11'. Conductor 7' is connected to the other conductor 15' by a bridgewire 12', which is in contact with the ignition charge 5'. Conductor 15' is electrically connected to the header 6' by the charge holder 4'. The bridgewire 12' is heated by current from the firing circuit to ignite the ignition charge 5'. The conductors 7' and 15' are maintained in spaced relationship with the header central through passage 10' by glass seal material 9'.

The base portion 13' of the header creates an interference fit with the metal cup 2'. Header 6' and metal cup 2' are attached at base portion 13' using a 360° penetration through laser weld 26. This weld joint acts to physically seal the enclosure and structurally retains the metal cup 2' onto the header 6' during functioning of initiator B.

The ceramic base 8' of initiator B has a cylindrical central passage 14', in which two conductors 7' and 15' extend. The conductors 7' and 15' are maintained in spaced relationship with each other by a glass sealing material 9' and through holes in the ceramic 16' and 17'. The glass sealing material 9' provides electrical isolation between the two conductors 7' and 15', and at the same time provides a secure physical connection of the header 6' and the ceramic base 8'. The glass seal formed further provides a hermetic seal between the two conductors 7' and 15'. The glass seal between the two conductors 7' and 15', and the ceramic base 8', and the header 6' and the two conductors 7' and 15', also provide a gas tight high pressure seal to the airbag inflation system when functioned to eliminate any leakage of gas from the inflator through the initiator assembly.

The ceramic base 8' is the strength carrying member of the initiator system with the load on initiator B being transferred from the header 6' to the ceramic base 8' at the interface 23', then through the ceramic base 8' to the support ledge 20'.

A plastic cup 1' fits over the metal cup 2' and electrically isolates the loaded initiator from the rest of the automobile's electrical systems, thereby avoiding accidental ignition of the initiator. Static protection is afforded by the electrical connections between the metal cup 2' and the header 6', to which conductor 15' is electrically connected, via projection welds 27*a*, 27*b*, charge holder 4' and header 6'

Initiator B may be crimped into an airbag inflator system, the installation of the device being achieved when the ceramic base 8' is fitted into a cylindrical space defined by a thin upstanding annular sleeve 22' formed as part of inflator 401 (FIG. 8). The upper edge 21' of the annular sleeve 22' is then crimped over tapered flange 19' trapping the ceramic base 8' and the gasket 18' thereby holding the initiator firmly and sealingly in place. The two conductors 7' and 15' extend through opening 24' in the airbag inflator system base.

Figure 3:
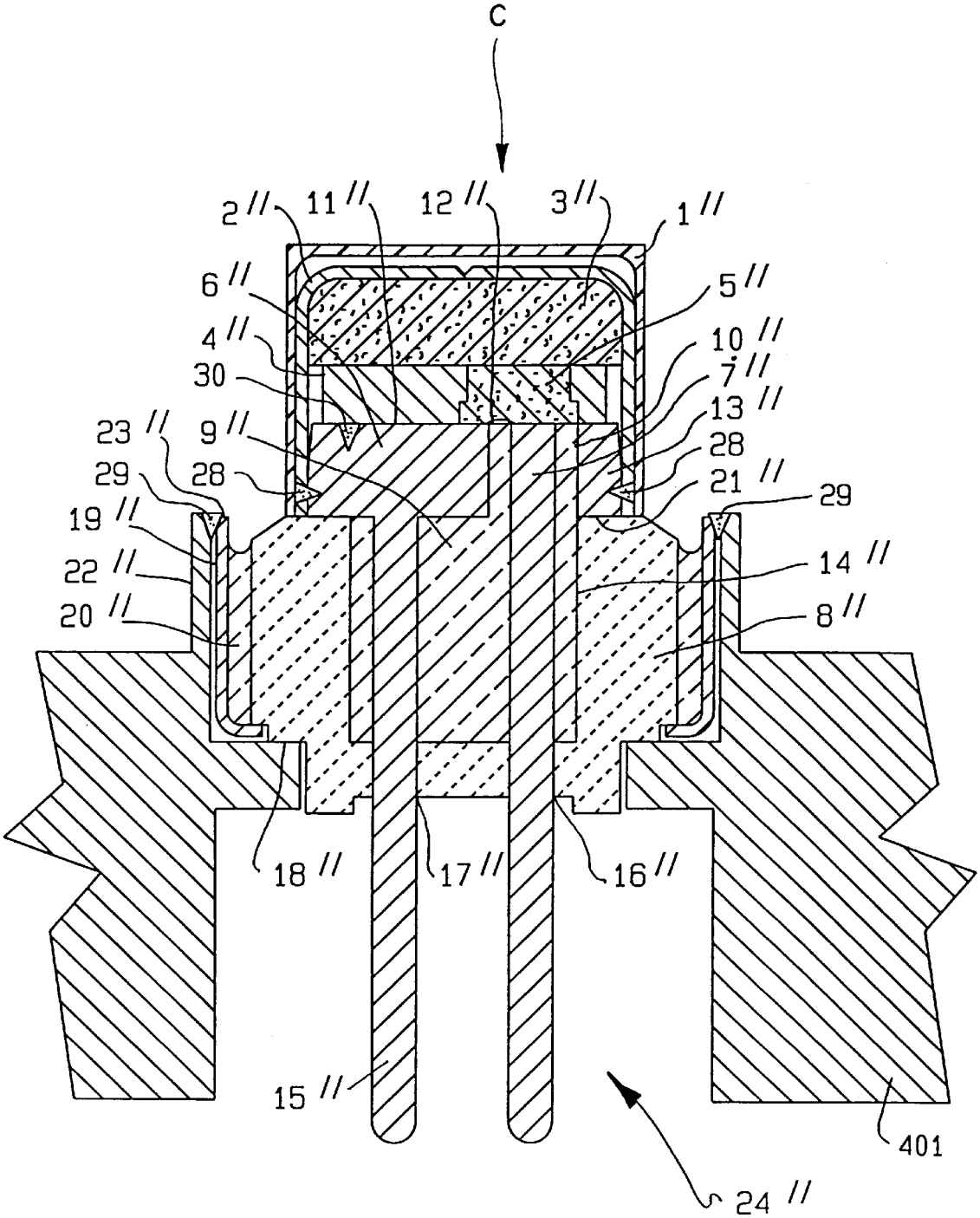
FIG. 3 is a third embodiment of the initiator designed to be welded in place capable of constant back pressure of 5000 psi, also constructed in accordance with the invention.

A further alternative version of the inventive initiator is shown in FIG. 3 where coaxial initiator C comprises a metal cup 2" welded at the base of the header 6". An ignition charge 5", typically a mixture of zirconium powder and potassium perchlorate is contained within the charge holder 4". The output charge 3", typically a mixture of titanium hydride powder and potassium perchlorate is contained within the metal cup 2". Charge holder 4" is welded to header 6" by weld 30. Other suitable charge materials may be used.

The header 6" has a cylindrical through passage 10", in which conductor 7" extends through and terminates at the upper surface 11" of header 6". Conductor 7" is connected to the header 6" by a bridgewire 12", which is in contact with the ignition charge 5". The bridgewire 12" is heated by current from a firing circuit to ignite the ignition charge 5". The conductor 7" is maintained in spaced relationship with the header through passage 10" by glass seal material 9".

The base portion 13" of the header 6" creates an interference fit with the metal cup 2". Header 6" and metal cup 2" are attached at base portion 13" of the header 6" using a 360° penetration through laser weld 28. This weld joint acts to physically seal the enclosure and structurally retains the metal cup 2 with header 6" during functioning of initiator C.

Ceramic base 8" of initiator C has a cylindrical central passage 14", in which two conductors 7" and 15" extend with the second conductor being an integral part of the header 6". The conductors 7" and 15" are maintained in spaced relationship with each other by a first glass seal material 9" and through holes 16" and 17" in ceramic base 8". The use of glass material 9" creates a seal to provide electrical isolation between the two conductors 7" and 15", and at the same time provides a secure physical connection between header 6" and the ceramic base 8". Such glass seal further provides a hermetic seal between the two conductors 7" and 15", and the ceramic base 8", and a hermetic seal between the header 6" and the conductor 7". Such glass seal between the two conductors 7" and 15", and the ceramic base 8", and the header 6" and the conductor 7", also provide a gas tight high pressure seal to the airbag inflation system, when functioned to eliminate any leakage of unfiltered gas from the inflator through the initiator assembly.

The ceramic base 8" is the strength carrying member of the initiator system in which the load on initiator C is transferred from the header 6" to the ceramic base 8" at the interface 21", then through the ceramic base 8" to the support ledge 18".

The ceramic base 8" and the support cup 19" are maintained in spaced relationship with each other by a second glass material seal 20" which at the same time provides a secure physical connection of the support cup 19" to the ceramic base 8". The second glass seal material 20" further provides a hermetic seal between the support cup 19" and the ceramic base 8".

Plastic cup 1" fits over the metal cup 2" and electrically isolates the loaded initiator from the rest of the automobile's electrical systems, thereby avoiding accidental ignition of the initiator. Static protection is afforded by the electrical connections between the metal cup 2", header 6", and conductor 15" which is a part of header 6".

This design is intended to be welded into the airbag inflator system with the installation of the device being achieved when the support cup 19" is fitted into a cylindrical space defined by a thin upstanding annular sleeve 22" formed as part of inflator 401. The upper edge 23" of the annular sleeve is then welded with weld 29 to the upper edge of the support cup 19" thereby holding the initiator firmly in place. The two conductors 7" and 15" extend through opening 24" in the airbag inflator system base.

Figure 4:
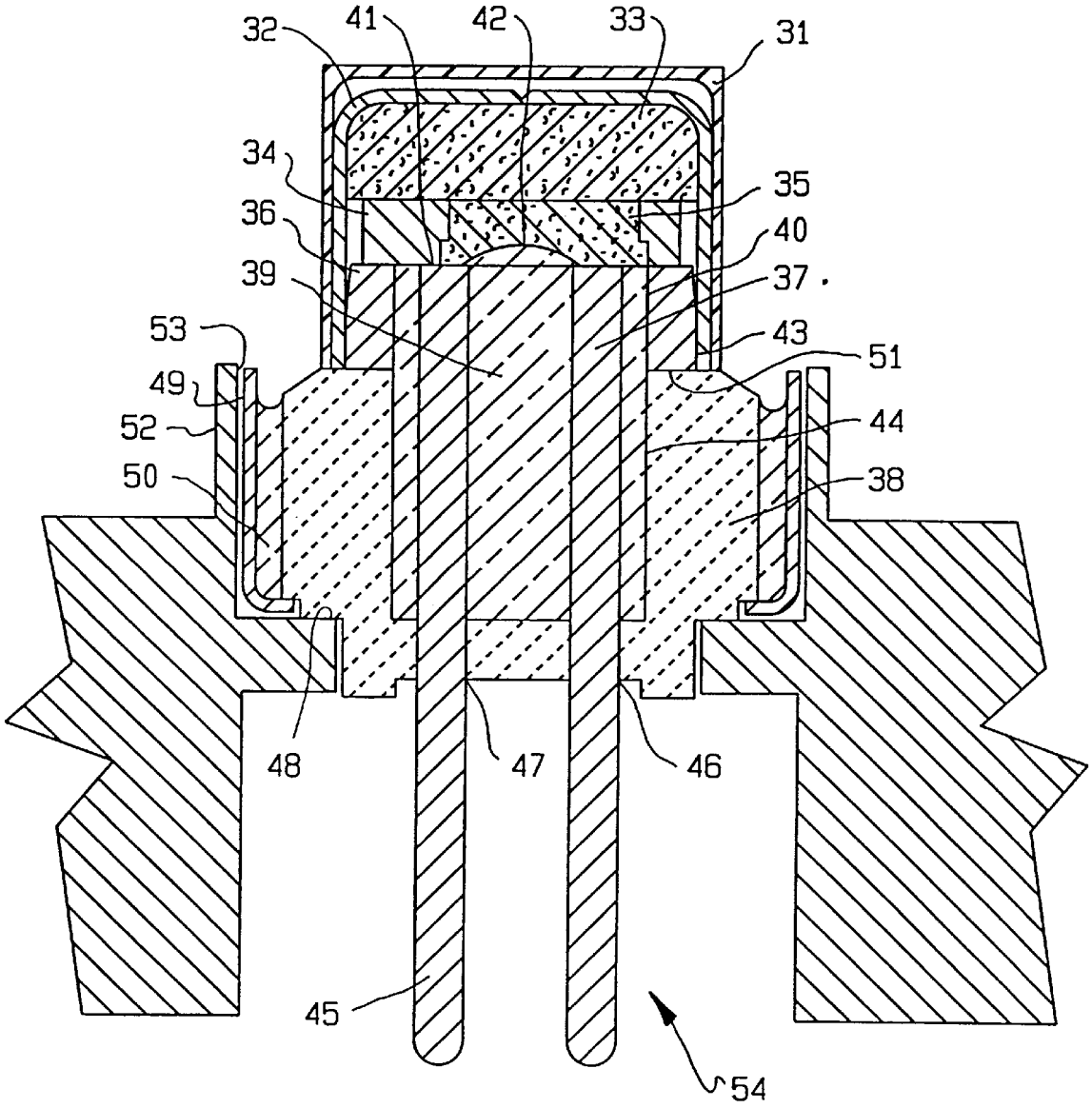
FIG. 4 is a fourth embodiment of the initiator designed to be welded in place and capable of withstanding a constant back pressure of 5000 psi, also constructed in accordance with the invention.

Another alternative version of the inventive initiator is shown in FIG. 4, where the coaxial initiator comprises a metal cup 32 welded at the base of the header 36. An ignition charge 35, typically a mixture of zirconium powder and potassium perchlorate is contained within the charge holder 34. The output charge 33, typically a mixture of titanium hydride powder and potassium perchlorate is contained within the metal cup 32.

Header 36 has a cylindrical central through passage 40, in which both conductor 37 and 45 extend, terminating at the upper surface 41. The conductor 37 is connected to the other conductor 45 by a bridgewire 42, which is in contact with the ignition charge 35. The conductor 45 is electrically connected to the header 36 by the charge holder 34. The bridgewire 45 is heated by current from the firing circuit to ignite the ignition charge 35. The conductors 37 and 45 are maintained in spaced relationship with the header central through passage 40 by a glass seal 39.

The base portion 43 of the header 36 creates an interference fit with the metal cup 32, the header 36 and metal cup 32 are attached at the base portion 43 of header 36 using a 360° penetration through laser weld (not shown). This weld joint acts to physically seal the enclosure and structurally retains the metal cup 32 onto the header 36 during functioning of the initiator.

The ceramic base 38 of the initiator has a cylindrical central passage 44, in which two conductors 37 and 45 extend. The conductors 37 and 45 are maintained in spaced relationship with each other by a first glass seal 39, created using glass material or other suitable material, and are further maintained in spaced relationship by through holes 46 and 47 in the ceramic base 38. The first glass seal 39 provides electrical isolation between conductors 37 and 45, and at the same time provides a secure physical connection of the header 36 and the ceramic base 38. The first glass seal 39 further provides electrical isolation between the two conductors 37 and 45, and at the same time provides a secure physical connection of the header 36 and the ceramic base 38. The first glass seal 39 further provides a hermetic seal between the two conductors 37 and 45, and the ceramic base 38, and a hermetic seal between the header 36 and the two conductors 37 and 45. The first glass seal 39 between the two conductors 37 and 45, and the ceramic base 38, and the header 36 and the two conductor 37 and 45, also provide a gas tight high pressure seal to the airbag inflation system, when functioned to eliminate any leakage of unfiltered gas from the inflator through the initiator assembly.

The ceramic base 38 is the strength carrying member of the initiator system, the load on the initiator is transferred from the header 36 to the ceramic base 38 at the interface 41, then through the ceramic base 38 to the support ledge 48.

Ceramic base 38 and the support cup 49 are maintained in spaced relationship with each other by a second glass seal 50 which provides a secure physical connection of the support cup 49 to ceramic base 38. The second glass seal 50 further provides a hermetic seal between the support cup 49 and the ceramic base 38.

A plastic cup 31 fits over the metal cup 32 and electrically isolates the loaded initiator from the rest of the automobiles electrical systems, thereby avoiding accidental ignition of the initiator. Static protection is afforded by the electrical connections between the metal cup 32 and the header 36 with conductor 45 being electrically connected by welding charge holder 34 to both header 36 and conductor 45, all as shown in FIG. 3.

This design is intended to be welded into the airbag inflator system which installation of the initiator being achieved when the support cup 49 is fitted into a cylindrical space defined by a thin upstanding annular sleeve 52 formed on the base. The upper edge 53 of the annular sleeve is then welded to the upper edge of the support cup 49 thereby holding the initiator firmly in place. The two conductors 37 and 45 extend through opening 54 in the airbag inflator system base. Such circular welding is shown in FIG. 3.

Figure 5:
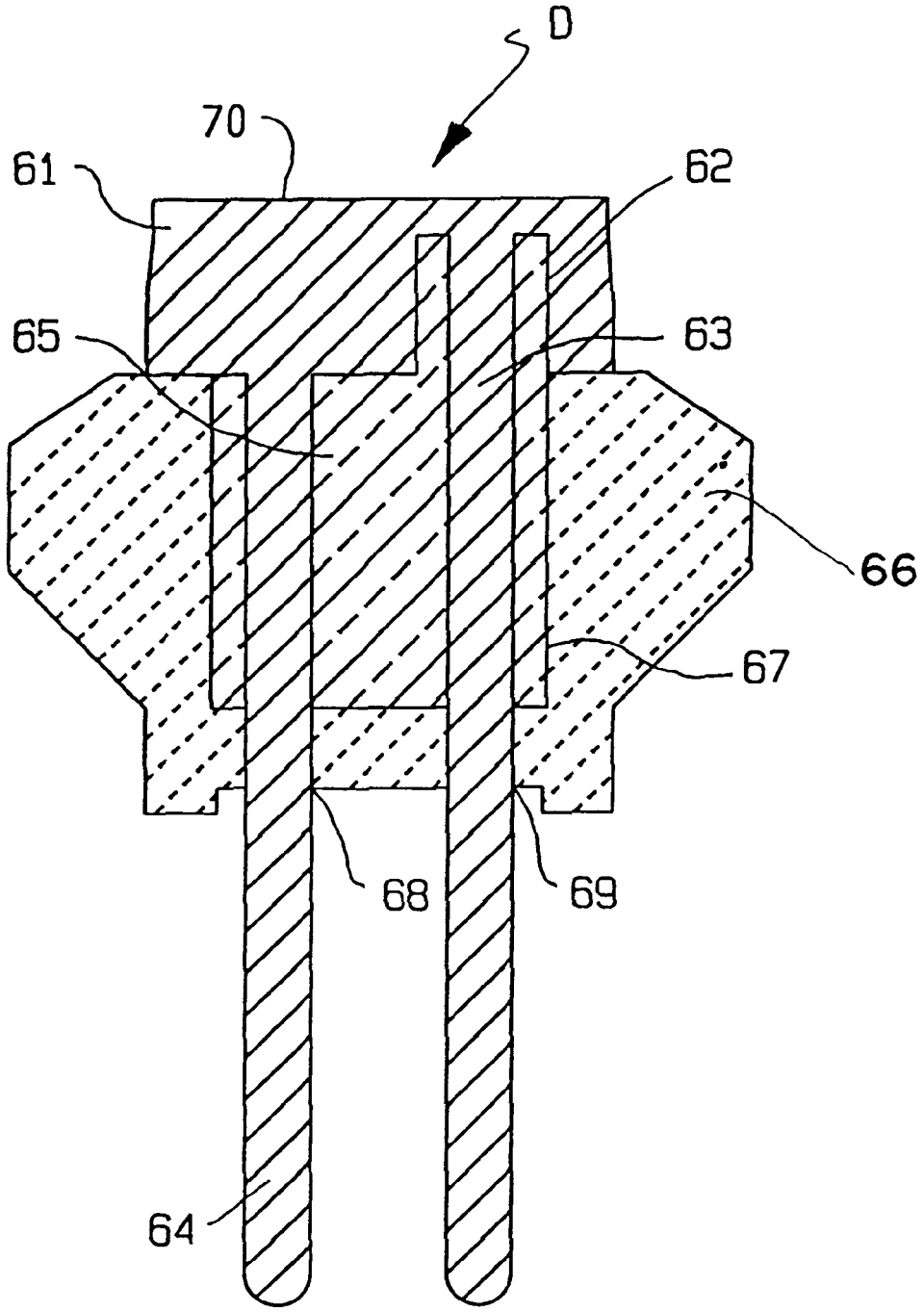
FIG. 5 is an axial section of a header assembly of the coaxial type, constructed in accordance with the invention.

Turning to FIG. 5, a coaxial header assembly D is shown comprising a header 61 with a cylindrical passage 62, in which one conductor 63 extends. Conductors 63 and 64 are part of the header 61, which part is preferably manufactured as a metal injection molded part. Conductor 63 is maintained in spaced relationship with the header central through passage 62 by a glass seal 65.

Ceramic base 66 of the header assembly has a cylindrical passage 67 in which conductors 63 and 64 extend with both conductors being an integral part of the header 61. Conductors 63 and 64 are maintained in spaced relationship with each other by glass sealing material 65 and through holes 68 and 69 in ceramic base 66. Such material 65 creates a glass seal which provides electrical isolation between the two conductors 63 and 64, and at the same time provides a secure physical connection of the header and the ceramic base 66. Such glass seal further provides a hermetic seal between the two conductors 63 and 64, and the ceramic base 66, and a hermetic seal between the header 61 and the conductor 63.

This design is intended to be built into a restraint inflator 401 with the electrical isolation of the conductor 63 being achieved when the top surface 70 of the header 61 is ground away exposing the glass seal material 65 and the conductor 63.

Figure 6:
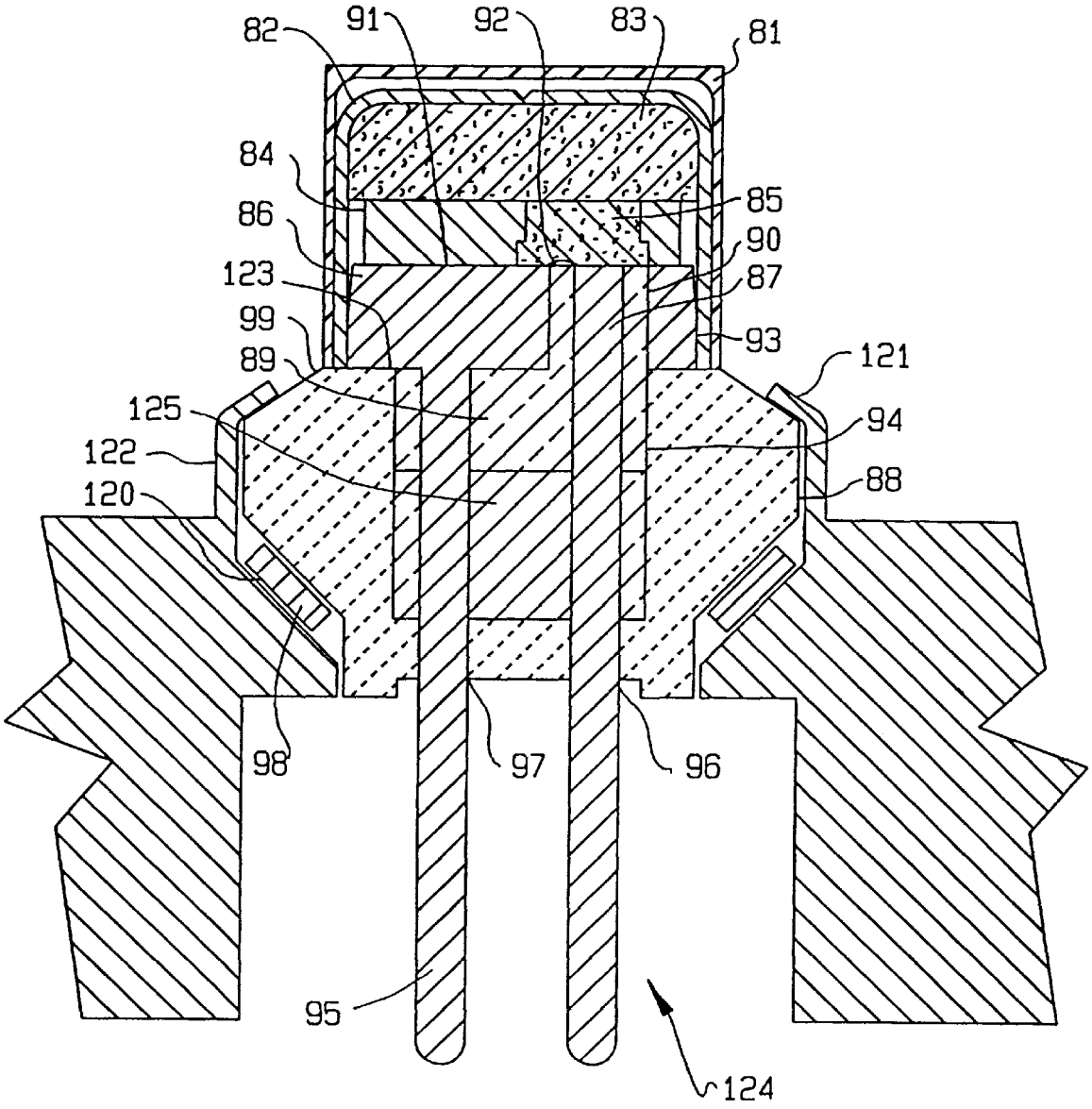
FIG. 6 is the initiator of FIG. 1 having built into the header assembly RFI filter properties.

In FIG. 6 a coaxial initiator comprises a metal cup 82 welded at the base 93 of the header 86. The weld is not shown. An ignition charge 85, typically a mixture of zirconium powder and potassium perchlorate is contained within the charge holder 84. The output charge 83, typically a mixture of titanium hydride powder and potassium perchlorate is contained within the metal cup 82.

Header 86 has a cylindrical through passage 90 with conductor 87 extending through and terminating at upper surface 91. The conductor 87 is connected to the header 86 by a bridgewire 92, which is in contact with the ignition charge 85. The bridgewire 92 is heated by current from the firing circuit to ignite the ignition charge 85. The conductor 87 is maintained in spaced relationship with the header central through passage 70 by a glass seal 89.

The base 93 of header 86 creates an interference fit with the metal cup 82, the header 86 and metal cup 82 are further attached at base 93 of the header 86 using a penetration through laser weld (not shown). The weld joint acts to physically seal the enclosure and structurally retains the metal cup 82 onto the header 86 during functioning of the initiator.

The ceramic base 88 of the initiator has a cylindrical central passage 94 in which conductors 87 and 95 extend with the second conductor 95 being an integral part of the header 86. Conductors 87 and 95 are maintained in spaced relationship with each other by a glass seal 89 and through holes 96 and 97 in the ceramic base 88. A ferromagnetic material 125 is maintained in spaced relationships with the ceramic base 88 and the two conductors 87 and 95 by a glass sealing material 89. Such glass seal provides electrical isolation between conductors 87 and 95, and at the same time provides a secure physical connection of the header 6 and the ceramic base 88. Such glass seal further provides a hermetic seal between conductors 87 and 95, and the ceramic base 88, and a hermetic seal between the header 86 and the conductor 87. The glass seal between the two conductors 87 and 95, and the ceramic base 88, and the header 86 and the conductor 87, also provide a gas tight high pressure seal to the airbag inflation system when functioned to eliminate any leakage of unfiltered gas from the inflator through the initiator assembly.

The ceramic base 88 is the strength carrying member of the initiator system, the load on the initiator is transferred from the header 86 to the ceramic base 88, at the interface 123, then through the ceramic base 88 to the support ledge 120.

A plastic cup 81 fits over the metal cup 82 and electrically isolates the loaded initiator from the rest of the automobile's electrical system, thereby avoiding accidental ignition of the initiator. Static protection is afforded by the electrical connections between the metal cup 82, header 86 and conductor 95 which is a part of header 86.

The design is intended to be crimped into the airbag inflator system with the installation of the device being achieved when ceramic base 88 is fitted into a cylindrical space defined by a thin upstanding annular sleeve 122 formed on the base. The upper edge 121 of the annular sleeve is then crimped over tapered surface 99 trapping ceramic base 88 and the gasket 98 thereby holding the initiator firmly and sealingly in place. Conductors 87 and 95 extend through opening 124 in the airbag inflator system base.

Figure 7:
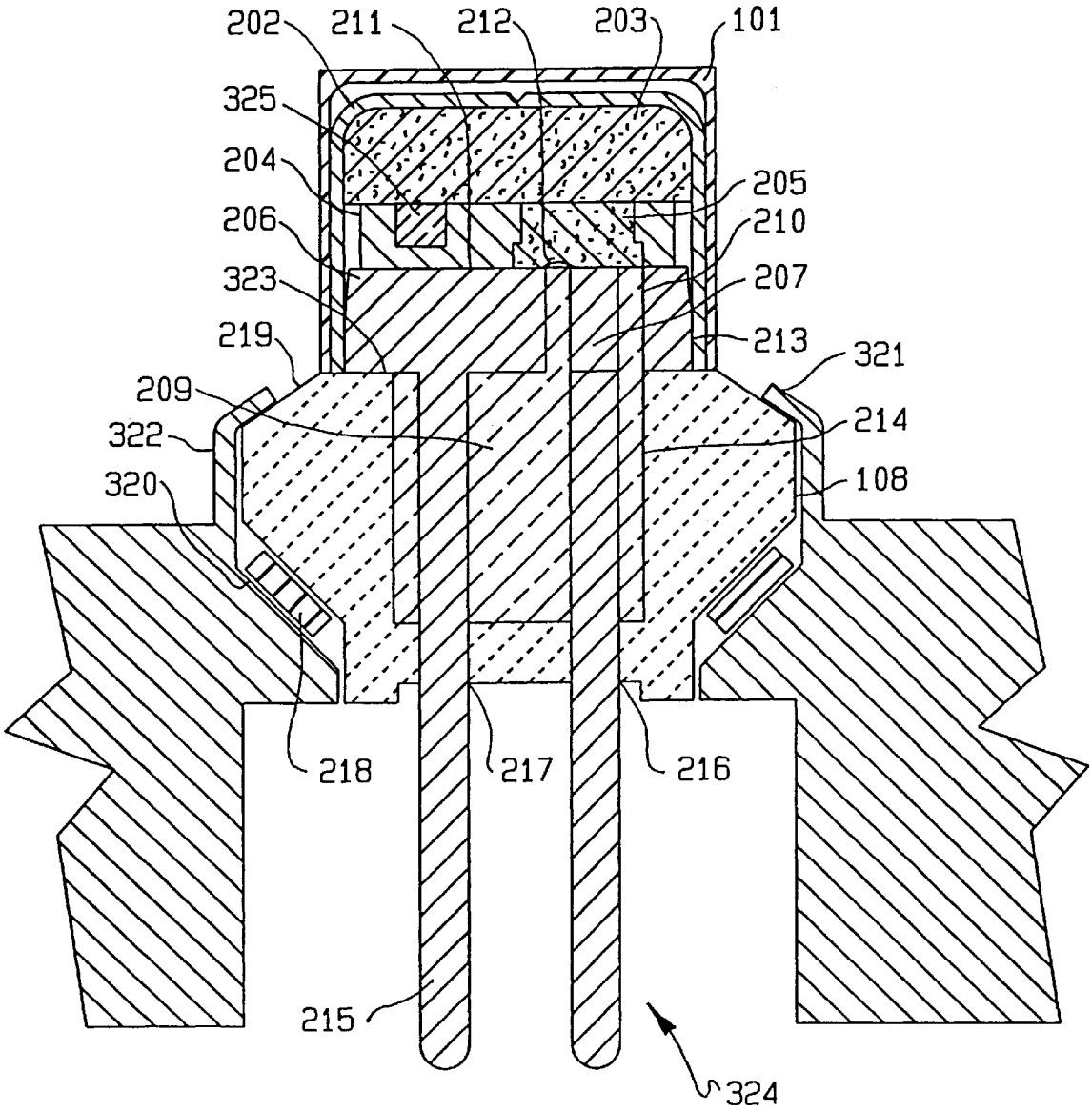
FIG. 7 is the initiator of FIG. 1 containing an autoignition charge constructed in accordance with the invention.

Finally, FIG. 7 illustrates a coaxial initiator similar to the initiator of FIG. 1 which comprises a metal cup 202 welded at base 213 of header 206. The weld is not shown. An ignition charge 205, typically a mixture of zirconium powder and potassium perchlorate and an autoignition charge 325, typically a mixture of a fuel and an oxidizer designed to ignite between 150° C. and 250° C., are contained within the charge holder 204. The output charge 203, typically a mixture of titanium hydride powder and potassium perchlorate is contained within the metal cup 202.

Header 206 has a cylindrical through passage 210, in which conductor 207 extends terminating at the upper surface 211 of the header. Conductor 207 is connected to header 206 by a bridgewire 212 which is in contact with the ignition charge 205. The bridgewire 212 is heated by current from the firing circuit to ignite the ignition charge 205. Conductor 207 is maintained in spaced relationship with the header central through passage 210 by glass seal material 209.

The base portion 213 of header 206 creates an interference fit with the metal cup 202. Header 206 and metal cup 202 are attached at the base of the header 213 using a penetration through laser weld (not shown). This weld joint acts to physically seal the enclosure and structurally retains the metal cup 202 onto the header 206 during functioning of the initiator.

The ceramic base 208 of the initiator has a cylindrical central passage 214, in which two conductors 207 and 215 extend, the second conductor is an integral part of the header 206. The conductors 207 and 215 are maintained in spaced relationship with each other by glass sealing material 209 and through holes 216 and 217 in ceramic base 208. The glass sealing material 209 provides electrical isolation between the two conductors 207 and 215, and at the same time provides a secure physical connection of the header 206 and the ceramic base 208. The glass seal formed by material 209 further provides a hermetic seal between the two conductors 207 and 215, and the ceramic base 208, and a hermetic seal between the header 206 and the conductor 207, also provide a gas tight high pressure seal to the airbag inflation system when functioned to eliminate any leakage of unfiltered gas from the inflator through the initiator assembly.

The ceramic base 208 is the strength carrying member of the initiator system upon which the load on the initiator is transferred from the header 206 to the ceramic base 208 at the interface 323, then through the ceramic base 208 to the support ledge 320.

A plastic cup 201 fits over the metal cup 202 and electrically isolates the loaded initiator from the rest of the automobile's electrical systems, thereby avoiding accidental ignition of the initiator. Static protection is afforded by the electrical connections between the metal cup 202 and the header 206, which the conductor 215 is part of.

With reference again to FIG. 7, the initiator described is useful when installed in an airbag inflator system in which the installation of the initiator is achieved by the ceramic base 208 being fitted into a cylindrical space defined by a thin upstanding annular sleeve 322 formed on the base. The upper edge 321 of the annular sleeve is then crimped over tapered flange 219 trapping the ceramic base 208 and the gasket 218 thereby holding the initiator firmly in place. The two conductors 207 and 215 extend through opening 324 in the airbag inflator system base.

In FIG. 8 a schematic view of a vehicle occupant protection apparatus including an inflator 401, inflator cavity 405, an initiator 402, an airbag 403, and a crash sensor with firing circuit 404. Initiator 402 may include any of the initiators described herein. When an initiator 402 is installed by welding or crimping in cavity 405 of inflator 401 pressurized gases cannot pass through or around initiator 402.

Figure 9:
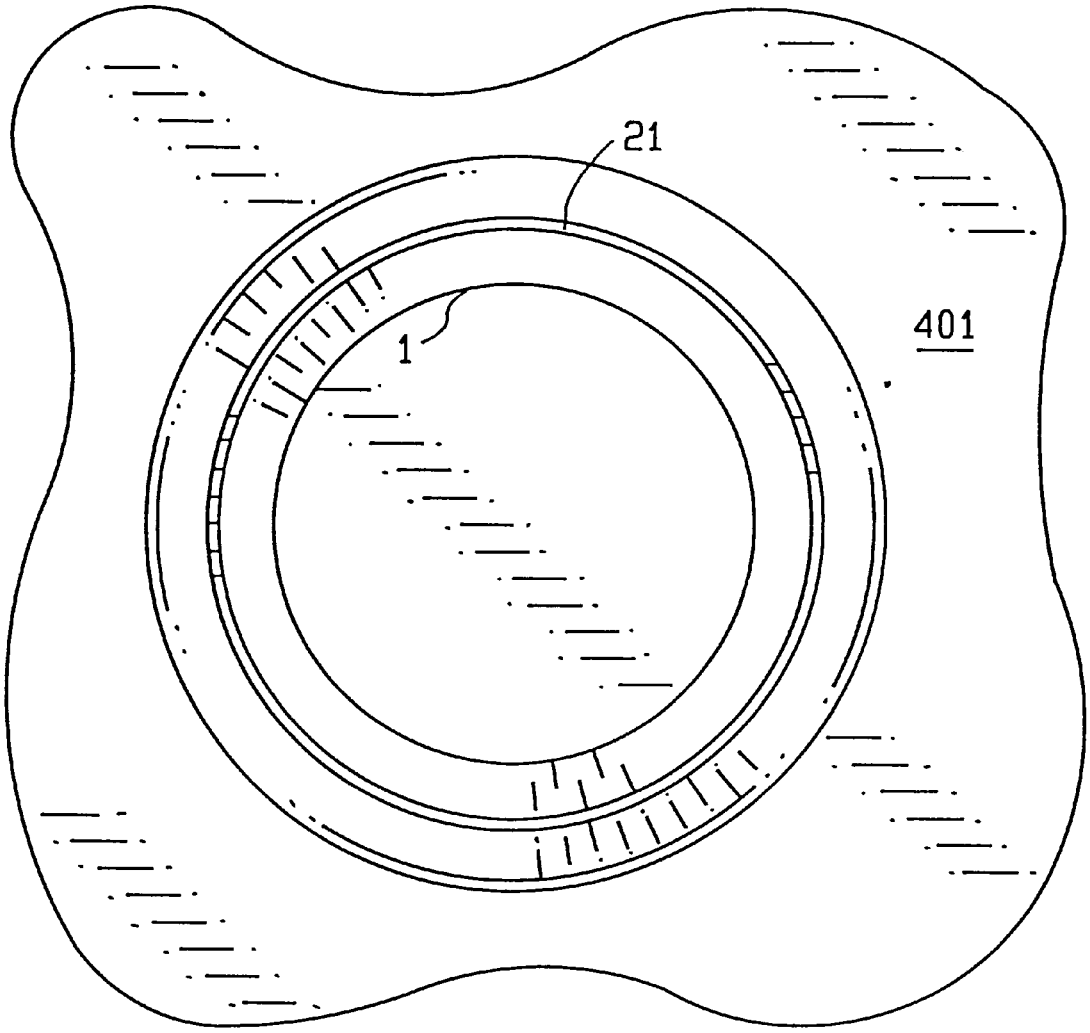
FIG. 9 is a plan view of the initiator of FIG. 1.

Turning finally to FIG. 9 showing the plan view of initiator A of FIG. 1, round ended plastic cup 1, upper edge 21 of sleeve 22 and a portion of inflator 401 are shown. All initiator embodiments have the same general configuration as shown in FIG. 9.

I claim:

1. An electroexplosive initiator for a pyrotechnic charge comprising:

an ignition charge;

a charge holder containing said ignition charge;

a header with said charge holder connected to the surface of the header, and having a header through passage with at least one of a pair of electrical conductors extending through said passage; a ceramic base having a base passage which base supports said header, the conductors being held in positions in said header through passage and in the base through passage by means for sealing said conductors in said through passages which means for sealing (a) is positioned in such through passages by introducing into such passages solidified glass elements, heating such glass elements to 800° C. or more in a protected atmosphere and allowing such heated glass to slowly cool to create a high pressure seal; and in which such sealing means (b) causes the ceramic base, header and the conductors to be connected together to form a hermetic seal to withstand 5,000 psi of static pressure and 75,000 psi peak pressure;

a firing circuit;

a bridge wire in contact with said ignition charge;

said pair of conductors connecting said bridge wire to said firing circuit, for igniting said ignition charge in response to a current in said conductors;

an output charge;

a metal cup fitting said header, said metal cup being attached to the header, and said metal cup containing the output charge;

a plastic cup of electrically nonconductive material fitted over the metal cup and attaching to the ceramic base;

whereby the initiator is structurally strong and hermetically sealed against substantial pressure and said header and said metal cup are electrically isolated from one of said pair of conductors absent the bridge wire.

2. An electroexplosive initiator according to claim 1 in which both of said conductors extend through said passage in said header and in which said sealing means maintains both of said conductors in spaced relationship to said header.

3. An electroexplosive initiator according to claim 1 having a ferromagnetic material in the base passage of the ceramic base.

4. An electroexplosive initiator according to claim 3 in which both of said conductors extend through said passage in said header and in which said sealing means maintains both of said conductors in spaced relationship to said header.

5. An electroexplosive initiator according to claim 1 having an autoignition mix in the charge holder.

6. An electroexplosive initiator according to claim 1 in which the sealing means is glass seal material and in which contained in the ceramic base is a ferromagnetic material adjacent the glass seal material.

7. An electroexplosive initiator according to claim 1 in which contained in the charge holder is an additional cavity containing an autoignition mix.

8. An assembly of the initiator of claim 1 and an inflator having an inflator cavity in which the initiator is positioned in the inflator cavity and crimped to form a gas-tight seal between the initiator and the inflator.

9. An assembly of the initiator of claim 1 and an inflator having an inflator cavity in which the initiator is positioned in the inflator cavity and welded to form a gas-tight seal between the initiator and the inflator.

10. The electroexplosive initiator of claim 1 in which the sealing means includes glass material.

11. The electroexplosive initiator of claim 1 in which the header and conductors are integrally formed.

12. The electroexplosive initiator of claim 1 in which the header and conductors are initially separately formed.

13. The initiator of claim 1 in which the means for sealing the conductors, in said through passages creates a hermetic seal.

14. The initiator of claim 1 in which the means for sealing for the conductors, in said through passages creates a gas tight high pressure seal.

15. In a combination of the initiator of claim 1 and an inflator the improvement comprising joining means for joining said initiator and inflator together, said joining means providing a gas-tight high pressure seal.

16. An electroexplosive initial for a pyrotechnic charge which initiator is installed in an inflator system comprising:

an ignition charge;

a charge holder containing said ignition charge;

a ceramic base;

a header with said charge holder welded to the surface of the header and said header having a through passage with at least one electrical conductor extending through said passage into said ceramic base;

a bridge wire in contact with said ignition charge;

said at least one electrical conductor and another conductor for connecting said bridge wire to a firing circuit for igniting said ignition charge in response to a current in said conductor;

sealing means in said passage of said header, said sealing means maintaining said at least one conductor and said other conductor in spaced relationship with said header and said ceramic base;

an output charge;

a metal cup fitting said header, said metal cup being welded to the header, and said metal cup containing the output charge;

a plastic cup of electrically nonconductive material fitted over the metal cup and attaching to the ceramic base;

a support cup having a through passage which contains the ceramic base;

second sealing means in said passage of support cup, said second sealing means maintaining said ceramic base in spaced relationship to said support cup;

whereby said header and said metal cup are electrically isolated from the inflator system.

17. An electroexplosive initiator for a pyrotechnic charge comprising:

an ignition charge;

a charge holder containing said ignition charge;

a header having a surface with said charge holder connected to said surface of the header and the header having a through passage;

a ceramic base having a passage which base supports said header;

a pair of electrical conductors positioned in said passages; and glass sealing and positioning means for positioning and sealing the conductors in the base and header passages and for attaching the header to said base in which the glass sealing and positioning means is positioned in such passages by introducing into such passages solidified glass elements, heating such glass elements to 800° C., or more in a protected atmosphere and allowing such heated glass to slowly cool to create a high pressure hermetic seal resistant to 5,000 psi static pressure and 75,000 psi peak pressure.

18. An electroexplosive initiator for a pyrotechnic charge comprising:

an ignition charge;

a charge holder containing said ignition charge;

a header with said charge holder connected to the surface of the header, and having a through passage with at least one of a pair of electrical conductors extending through said passage;

a ceramic base having a through passage which base supports said header;

a firing circuit;

a bridge wire in contact with said ignition charge;

said pair of conductors connecting said bridge wire to said firing circuit for igniting said ignition charge in response to a current in said conductors which conductors extend through said passage in said header and are held in spaced relationship in said header and being held in position in said ceramic base through passage by means of sealing said conductors in said header and said through passage which means for sealing (a) is positioned in such through passages by introducing into such passages solidified glass elements, heating such glass elements to 800° C. or more in a protected atmosphere and allowing such heated glass to slowly cool to create a high pressure seal; and in which such sealing means (b) causes the ceramic base, header and the conductors to be connected together to form a hermetic seal to withstand 5,000 psi of static pressure and 75,000 psi peak pressure;

an output charge;

a metal cup fitting said header, said metal cup being attached to the header, and said metal cup containing the output charge;

a plastic cup of electrically nonconductive material fitted over the metal cup and attaching to the ceramic base;

whereby the initiator is structurally strong and said header and said metal cup are electrically isolated from one of said pair of conductors absent the bridge wire.

19. The electroexplosive initiator of claim 18 in which the header and conductors are integrally formed.

20. The electroexplosive initiator of claim 18 in which the header and conductors are initially separately formed.

21. An electroexplosive initiator for a pyrotechnic charge comprising:

an ignition charge;

a charge holder containing said ignition charge;

a header with said charge holder connected to the surface of the header, and having a through passage with at least one of a pair of electrical conductors extending through said passage;

a ceramic base having a through passage which base supports said header;

a ferromagnetic material in said through passage of said ceramic base;

a firing circuit;

a bridge wire in contact with said ignition charge; said pair of conductors connecting said bridge wire to said firing circuit for igniting said ignition charge in response to a current in said conductors which conductors extend through said passage in said header, and are held in spaced relationship in said header and being held in position in said ceramic base through passage by means of sealing said conductors in said header and said through passage which means for sealing (a) is positioned in such through passages by introducing into such passages solidified glass elements, heating such glass elements to 800° C. or more in a protected atmosphere and allowing such heated glass to slowly cool to create a high pressure seal; and in which such sealing means (b) causes the ceramic base, header and the conductors to be connected together to form a hermetic seal to withstand 5,000 psi of static pressure and 75,000 psi peak pressure;

an output charge;

a metal cup fitting said header, said metal cup being attached to the header, and said metal cup containing the output charge;

a plastic cup of electrically nonconductive material fitted over the metal cup and attaching to the ceramic base;

whereby the initiator is structurally strong and said header and said metal cup are electrically isolated from one of said pair of conductors absent the bridge wire.

22. An electroexplosive initiator for a pyrotechnic charge and an outer mounting cup comprising:

a) said electroexplosive initiator in turn comprising an ignition charge;

a charge holder containing said ignition charge;

a header with said charge holder connected to the surface of the header, and having a through passage with at least one of a pair of electrical conductors extending through said passage;

a ceramic base having an exterior surface and a through passage which base supports said header;

a firing circuit;

a bridge wire in contact with said ignition charge;

said pair of conductors connecting said bridge wire to said firing circuit for igniting said ignition charge in response to a current in said conductors with at least one of such conductors extending through said through passage in said header and being held in spaced relationship in said header and further being held in position in said ceramic base through passage by means of sealing said conductors in said header and said base through passage;

an output charge;

a metal cup fitting said header, said metal cup being attached to the header, and said metal cup containing the output charge;

a plastic cup of electrically nonconductive material fitted over the metal cup and attached to the ceramic base; and (b) an outer mounting cup in turn comprised of a conductive material held in spaced relationship to said ceramic base by means for sealing said mounting means to the exterior surface of said ceramic base;

whereby the initiator is structurally strong and said header and said metal cup are electrically isolated from one of said pair of conductors absent the bridge wire.

23. An assembly of the electroexplosive initiator and outer mounting cup of claim 22 and an inflator having an inflator cavity in which the initiator is positioned in the inflator cavity and welded at the outer mounting means to form a long term continuous high pressure seal between the inflator and the initiator.

24. The electroexplosive initiator of claim 22 in which one or more of said means for sealing includes glass material.

25. The electroexplosive initiator of claim 22 in which the means for sealing the conductors, in said through passages creates a hermetic seal.

26. The electroexplosive initiator for a pyrotechnic charge and an outer mounting cup of claim 22 in which the means for sealing the conductors provides a hermetic seal, and the means for sealing the mounting means and exterior surface with said ceramic base provides a gas tight high pressure seal.

27. An electroexplosive initiator for a pyrotechnic charge and an outer mounting cup in combination comprising:

(a) an initiator comprising an ignition charge;

a charge holder containing said ignition charge;

a header with said charge holder connected to the surface of the header, and having a through passage with at least one of a pair of electrical conductors extending through said passage;

a ceramic base having a through passage which base supports said header;

a ferromagnetic material in said through passage of said ceramic base;

a firing circuit;

a bridge wire in contact with said ignition charge;

said pair of conductors connecting said bridge wire to said firing circuit for igniting said ignition charge in response to a current in said conductors with at least one of such conductors extending through said passage in said header and being held in spaced relationship in said header and further being held in position in said ceramic base through passage by means of sealing said conductors in said header and said base through passage;

an output charge;

a metal cup fitting said header, said metal cup being attached to the header, and said metal cup containing the output charge;

a plastic cup of electrically nonconductive material fitted over the metal cup; and (b) an outer mounting means comprised of a conductive material held in spaced relationship to said ceramic base by sealing means.

whereby the initiator is structurally strong and said header and said metal cup are electrically isolated from one of said pair of conductors absent the bridge wire.

28. An assembly of the electroexplosive initiator of claim 27 and an inflator having an inflator cavity in which the initiator is positioned in the inflator cavity and welded at the outer mounting means to form a long term continuous high pressure seal between the inflator and the initiator.

29. The electroexplosive initiator of claim 27 in which one or more of said means of sealing includes glass material.

30. The electroexplosive initiator of claim 27 in which the means for sealing the conductors within the passages creates a hermetic seal.

31. The electroexplosive initiator for a pyrotechnic charge and outer mounting means of claim 27 in which the means for sealing said conductors provides a hermetic seal, and the sealing means for holding the mounting means in spaced relationship to said ceramic base provides a gas tight high pressure seal.

32. A header assembly for an electroexplosive initiator comprising:

a metal header having a opening therein which opening has interior surfaces;

a ceramic base supporting said header;

a passage in the ceramic base which passage has interior surfaces;

a pair of conductors for positioning in an initiator opening in turn comprising the header opening and the base passage; and sealing means in the header opening and base passage to maintain said conductors in spaced relationship to the header and base which sealing means adheres to the interior surfaces of both the base and the metal header and in which said sealing means (a) is positioned in such header opening and ceramic passage by introducing into such opening and passage solidified glass elements, heating such glass elements to 800° C. or more in a protected atmosphere and allowing such heated glass to slowly cool to create a high pressure seal; and in which such sealing means (b) causes the ceramic base, header and the conductors to be connected together to form a hermetic seal to withstand 5,000 psi of static pressure and 75,000 psi peak pressure.

33. The header assembly of claim 32 in which the sealing means is glass sealing means.

34. The header assembly of claim 32 having a charge holder positioned above the header.

35. The header assembly of claim 32 having in addition an output charge and in addition a metal cup attached to the header containing the output charge.

36. The header assembly of claim 32 in which the sealing means forms a hermetic seal preventing air from passing through the sealing means and preventing air passing between the sealing means adjacent the header, base and conductors.

37. The header assembly of claim 32 in which both conductors are positioned in the header opening.

38. A header assembly for an electroexplosive initiator comprising:

a metal header having an opening therein which opening has interior surfaces;

a ceramic base supporting said header;

a passage in the ceramic base which passage has interior surfaces;

a pair of conductors for positioning in the header opening and base passage;

sealing means in the header opening and base passage adjacent the header interior surfaces, base interior surfaces and conductors to maintain said conductors in spaced relationship to the header and base; and which sealing means (a) is positioned in such through passages by introducing into such passages solidified glass elements, heating such glass elements to 800° C. or more in a protected atmosphere and allowing such heated glass to slowly cool to create a high pressure seal; and in which such sealing means (b) causes the ceramic base, header and the conductors to be connected together to form a hermetic seal to withstand 5,000 psi of static pressure and 75,000 psi peak pressure.

said sealing means forming a hermetic seal preventing air from passing through the sealing means and preventing air passing between the sealing means adjacent the header interior surfaces, base interior surfaces and conductors.

39. The header assembly of claim 38 in which both conductors are positioned in the header opening.

40. An electroexplosive initiator for a pyrotechnic charge which initiator is installed in an inflator system comprising:

an ignition charge;

a charge holder containing said ignition charge;

a ceramic base;

a header and first and second electrical conductors each separately formed;

said charge holder welded to the surface of the header which header has a through passage with at least one of said electrical conductors extending through said passage into said ceramic base;

a bridge wire in contact with said ignition charge;

said first electrical conductor and a second conductor for connecting said bridge wire to a firing circuit for igniting said ignition charge in response to a current in said conductors;

sealing means in said passage of header, said sealing means maintaining said first conductor and said second conductor in spaced relationship with said header and said ceramic base;

an output charge;

a metal cup fitting said header, said metal cup being welded to the header, and said metal cup containing the output charge;

a plastic cup of electrically nonconductive material fitted over the metal cup and attaching to the ceramic base;

a support cup having a through passage which contains the ceramic base;

second sealing means in said passage of said support cup, said second sealing means maintaining said ceramic base in spaced relationship to said support cup;

whereby said header and said metal cup are electrically isolated from the inflator system.

41. An electroexplosive initiator for a pyrotechnic charge comprising:

an ignition charge;

a charge holder containing said ignition charge;

a header having an upper surface and two electrical conductors with the header and each conductor separately formed; said header having the charge holder connected to its surface, and having a passage with a first of the pair of electrical conductors extending through said passage which passage has header passage interior surfaces;

the second conductor connected to the header;

a ceramic base having a base passage with base interior surfaces which base supports said header, the conductors being held in position in said header passage and in the base passage by means for sealing said conductors in said passages which means for sealing adheres to said conductors, said header passage surfaces and said base surfaces which means for sealing (a) is positioned in such through passages by introducing into such passages solidified glass elements, heating such glass elements to 800° C. or more in a protected atmosphere and allowing such heated glass to slowly cool to create a high pressure seal; and in which such sealing means (b) causes the ceramic base, header and the conductors to be connected together to form a hermetic seal to withstand 5,000 psi of static pressure nd 75,000 psi peak pressure;

a bridge wire; and an output charge.

42. An electroexplosive initiator for a pyrotechnic charge which initiator is installed in an inflator system comprising:

an ignition charge;

a charge holder containing said ignition charge;

a ceramic base;

a header with said charge holder welded to the surface of the header and said header having a through passage with a first electrical conductor extending through said passage into said ceramic base;

a bridge wire in contact with said ignition charge;

said first electrical conductor and a second electrical conductor for connecting said bridge wire to a firing circuit for igniting said ignition charge in response to a current in said conductors;

sealing means in said header and base passages, said sealing means maintaining said first conductor and said second conductor in spaced relationship with said header and said ceramic base;

an output charge;

a metal cup fitting said header, said metal cup being welded to the header, and said metal cup containing the output charge;

a plastic cup of electrically nonconductive material fitted over the metal cup and attaching to the ceramic base;

a support cup having a through passage which contains the ceramic base;

second sealing means in said passage of said support cup, said second sealing means maintaining said ceramic base in spaced relationship to said support cup;

whereby said header and said metal cup are electrically isolated from the inflator system.

43. The initiator of claim 42 in which the second sealing means in the support cup provides a hermetic seal between the cup and the ceramic base.

* * * * *

UNITED STATES PATENT AND TRADEMARK OFFICE

CERTIFICATE OF CORRECTION

PATENT NO. : 5,988,069

DATED : November 23, 1999

INVENTOR(S) : Todd Raymond Bailey

It is certified that error appears in the above-identified patent and that said Letters Patent is hereby corrected as shown below:

On the title page, item:

[73] Assignee: Universal Propulsion Company, Inc.
Phoenix, Ark. should read

--Universal Propulsion Company, Inc.
Phoenix, AZ--.

Column 7, line 26, "two conductor" should read --two conductors--.
Column 7, lines 41-2, "automobiles electrical" should read --automobile's electrical--.
Column 11, line 36, "initial for" should read --initiator for--.
Column 17, line 10, "nd" should read --and--.

Signed and Sealed this

Eighth Day of August, 2000

*Attest:*

Q. TODD DICKINSON

*Attesting Officer*

*Director of Patents and Trademarks*